US011652303B2

(12) United States Patent
Chang et al.

(10) Patent No.: US 11,652,303 B2
(45) Date of Patent: May 16, 2023

(54) TERMINAL ASSEMBLY

(71) Applicants: SOLTEAM ELECTRONICS (DONG GUAN) CO., LTD., Dong Guan (CN); SOLTEAM ELECTRONICS (SU ZHOU) CO., LTD., Wu Jiang (CN); Solteam Incorporation, Taoyuan (TW)

(72) Inventors: Chun-Yun Chang, Taoyuan (TW); Ying-Sung Ho, Taoyuan (TW); Ta-Feng Yeh, Taoyuan (TW); Cheng-Wei Lu, Taoyuan (TW); Chia-Yu Chiu, Taoyuan (TW)

(73) Assignees: SOLTEAM ELECTRONICS (DONG GUAN) CO., LTD., Dong Guan (CN); SOLTEAM ELECTRONICS (SU ZHOU) CO., LTD., Wu Jiang (CN); SOLTEAM INCORPORATION, Taoyuan (TW)

( * ) Notice: Subject to any disclaimer, the term of this patent is extended or adjusted under 35 U.S.C. 154(b) by 0 days.

(21) Appl. No.: 17/349,783

(22) Filed: Jun. 16, 2021

(65) Prior Publication Data

US 2022/0085522 A1 Mar. 17, 2022

(30) Foreign Application Priority Data

Sep. 16, 2020 (CN) ..... 202022021216.X

(51) Int. Cl.

| | |
|---|---|
| ***H01R 4/02*** | (2006.01) |
| ***H01R 4/58*** | (2006.01) |
| ***H01R 43/02*** | (2006.01) |

(52) U.S. Cl.

CPC ..... *H01R 4/023* (2013.01); *H01R 4/58* (2013.01); *H01R 43/0207* (2013.01)

(58) Field of Classification Search

CPC . H01R 4/02; H01R 4/023; H02G 3/04; H02G 15/18

See application file for complete search history.

(56) References Cited

U.S. PATENT DOCUMENTS 3,336,056 A * 8/1967 Cassel ..... F01N 13/1805 29/890.08
4,085,284 A * 4/1978 Olszewski ..... H01B 11/085 174/107

(Continued)

FOREIGN PATENT DOCUMENTS

GB 2152735 * 8/1985

*Primary Examiner* — Chau N Nguyen

(74) *Attorney, Agent, or Firm* — Anova Law Group, PLLC

(57) ABSTRACT

A terminal assembly is disclosed. The terminal assembly comprises a main body having a welding platform and a first electrical conductive member having a connection terminal. According to the present invention, a welded structure is formed between the main body and the first electrical conductive member by making the connection terminal be welded on the welding platform. Briefly speaking, when utilizing this terminal assembly to make two electrical nodes be electrically connected to each other, one electrical conductive end of the main body and the first electrical conductive member are firstly connected to the two electrical nodes, respectively. Next, a welding process is applied to the welding platform and the connection terminal, such that an electrical connection is therefore established between the two electrical nodes.

8 Claims, 6 Drawing Sheets

(56) References Cited

U.S. PATENT DOCUMENTS

| | | | | |
|---|---|---|---|---|
| 10,897,096 | B2 * | 1/2021 | Izawa | H01R 4/02 |
| 11,050,170 | B2 * | 6/2021 | Fujioka | H01R 43/048 |
| 2011/0062218 | A1 * | 3/2011 | Ohnuma | B23K 20/106 228/110.1 |
| 2019/0337472 | A1 * | 11/2019 | Nakai | H01R 4/60 |
| 2020/0243216 | A1 * | 7/2020 | Fujioka | H01B 7/0045 |

* cited by examiner

TERMINAL ASSEMBLY

BACKGROUND OF THE INVENTION

1. Field of the Invention

The present invention relates to the technology field of electrical terminals, and more particularly to a terminal assembly with welded structures.

2. Description of the Prior Art

How to make an electrical terminal be connected with an electrical node on a circuit board effectively is always an important issue engineers particularly concerned. Therefore, U.S. Pat. No. 4,681,393 discloses an electrical connector assembly, which one or more insulative housings, surrounding one or more electrically conductive female terminals forming one or more female terminal assemblies, and one or more insulative housings surrounding one or more male terminals forming one or more male terminal assemblies. According to the disclosures of U.S. Pat. No. 4,681,393, the female terminal is cut and formed or bent from a flat sheet of metal stock, and is formed to provide a male terminal-receiving front end. The female terminal 20 also includes a rear end, and the rear end includes a pair of electrically conductive bendable tabs surrounding a wire receiving lower channel adapted to be bent or clinched over a bare wire or other circuit element disposed within the wire receiving channel. In accordance with an important feature of the electrical connector assembly, the female terminal is bent or formed from flat metal having longitudinal end walls formed or bent to dispose the end walls in close proximity to form a first slit defined by the adjacent end walls. The slit extends from a terminal-receiving opening defined by the formed metal at the terminal-receiving front end of the female terminal.

However, the electrical connector assembly disclosed by U.S. Pat. No. 4,681,393 exhibits many drawbacks in practical use. First, complex structures of the female terminal and/or the male terminal both lead the manufacturing process of the electrical connector assembly to become complicated. Furthermore, the complicated manufacturing process causes that it is difficult to maintain the production yield of the electrical connector assembly at an ideal value, thereby enhancing the defect rate of the produced electrical connector assembly. It is imaginable that, in case of an electrical connector assembly including defects being connected with an electrical node on a circuit board, a poor electrical connection may occur between the electrical node and the connector assembly.

From above descriptions, it is understood that there are still rooms for improvement in the conventional the electrical connector assembly disclosed by U.S. Pat. No. 4,681,393. In view of that, inventors of the present application have made great efforts to make inventive research and eventually provided a terminal assembly with welded structures.

SUMMARY OF THE INVENTION

The primary objective of the present invention is to disclose a terminal assembly, which mainly comprises a main body having a welding platform and a first electrical conductive member having a connection terminal. According to the present invention, a welded structure is formed between the main body and the first electrical conductive member by making the connection terminal be welded on the welding platform. Briefly speaking, when utilizing this terminal assembly to make two electrical nodes be electrically connected to each other, one electrical conductive end of the main body and the first electrical conductive member are firstly connected to the two electrical nodes, respectively. Next, a welding process is applied to the welding platform and the connection terminal, such that an electrical connection is therefore established between the two electrical nodes. Therefore, the terminal assembly according to the present invention includes advantages of simple structure and easy to be applied in achieving an electrical connection between two electrical nodes.

In order to achieve the primary objective of the present invention, inventors of the present invention provides an embodiment of the terminal assembly, which comprises:

a main body, comprising a first connection part, wherein one end of the first connection part is an electrical conductive end, and another one end of the first connection part being provided with a first welding platform; and a first electrical conductive member, having a first connection terminal;

wherein a first welded structure is formed between the first connection part and the first electrical conductive member by making the first connection terminal be welded on the first welding platform.

In one embodiment, the main body further comprises a second connection part, wherein one end of the second connection part is also an electrical conductive end, and another one end of the second connection part is provided with a second welding platform.

In one embodiment, the terminal assembly device according to the present invention further comprises a second electrical conductive member having a second connection terminal, wherein a second welded structure is formed between the second connection part and the second electrical conductive member by making the second connection terminal be welded on the second welding platform.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a terminal assembly with welded structures disclosed by the present invention, embodiments of the present invention will be described in detail with reference to the attached drawings hereinafter.

First Embodiment

Figure 1:
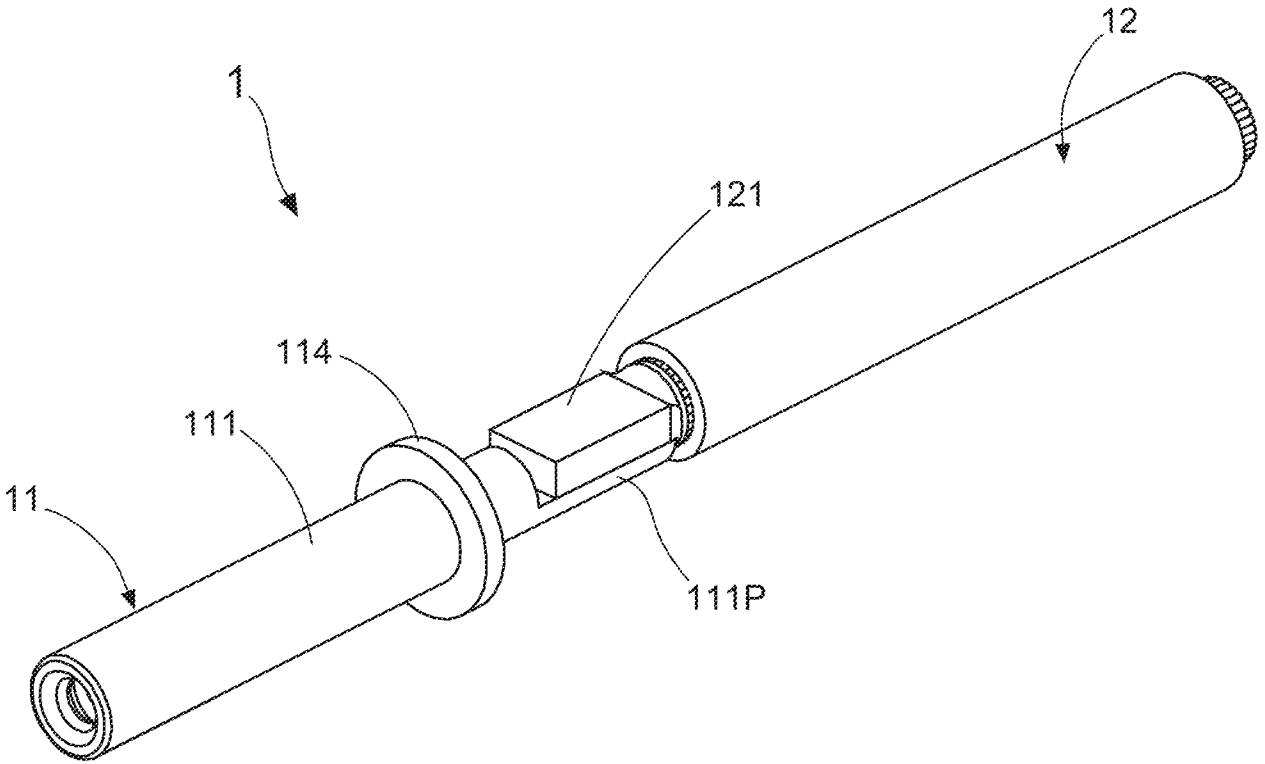
FIG. 1 shows a first stereo diagram of a terminal assembly according to the present invention.
Figure 2:
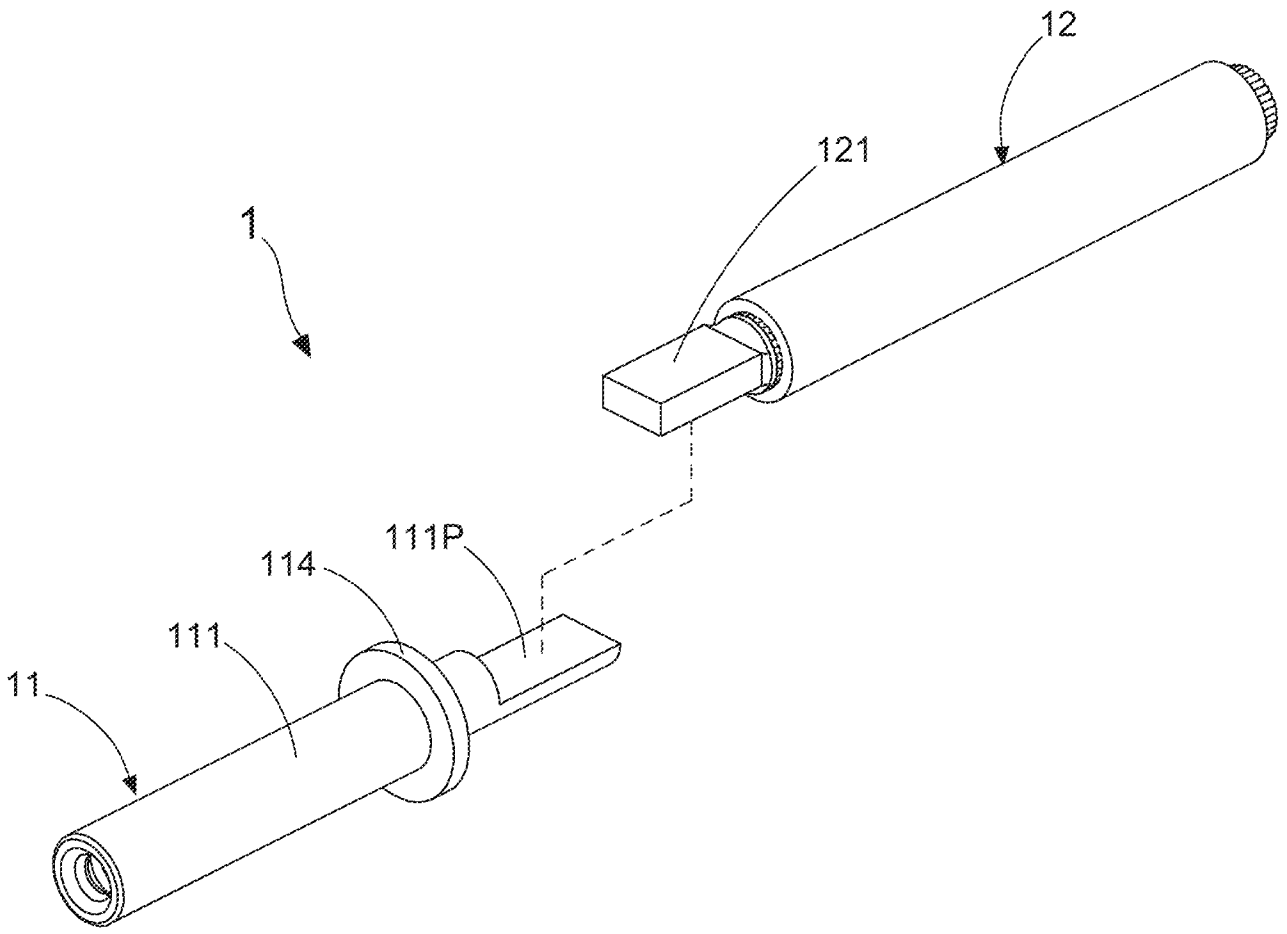
FIG. 2 shows a first exploded view of the terminal assembly according to the present invention.

With reference to FIG. 1, there is shown a first stereo diagram of a terminal assembly according to the present invention. Moreover, FIG. 2 shows a first exploded view of the terminal assembly according to the present invention. As FIG. 1 and FIG. 2 show, the terminal assembly 1 mainly comprises a main body 11 and a first electrical conductive member 12. The main body 11 comprises a first connection part 111, and the first electrical conductive member 12 has a first connection terminal 121. According to the present invention, one end of the first connection part 111 is an electrical conductive end, and another one end of the first connection part 111 is provided with a first welding platform 111P. In practicable embodiments, the first welding platform 111P can be a half-cylinder platform, a regular-hexahedron platform, or a rectangular-parallelepiped platform. For example, FIG. 1 and FIG. 2 depict that the first welding platform 111P is a rectangular-parallelepiped platform. Therefore, by operating an ultrasonic welding apparatus, the first connection terminal 121 is welded on the first welding platform 111P, thereby forming a first welded structure is formed between the first connection part 111 and the first electrical conductive member 12. Briefly speaking, when utilizing this terminal assembly 1 to make two electrical nodes be electrically connected to each other, one electrical conductive end of the first connection part 111 of the main body 11 and the first electrical conductive member 12 are firstly connected to the two electrical nodes, respectively. Next, an ultrasonic welding process is applied to the first welding platform 111P of the first connection part 111 and the first connection terminal 121 of the first electrical conductive member 12, such that an electrical connection is therefore established between the two electrical nodes. Therefore, the terminal assembly 1 according to the present invention includes advantages of simple structure and easy to be applied in achieving an electrical connection between two electrical nodes.

As described in more detail below, there is a first circular-shaped flange 114 provided on the first connection part 111. Moreover, the first connection terminal 121 of the first electrical conductive member 12 is a stereo terminal, such as half-cylinder terminal, regular-hexahedron terminal, or rectangular-parallelepiped terminal. It is worth mentioning that, the first electrical conductive member 12 can be a conductive wire, and comprises a first electrical insulative sheath 123 and a plurality of first copper conductors 122 that are enclosed in the first electrical insulative sheath 123. As FIG. 1 and FIG. 2 show, the first copper conductors 122 are electrically connected to the first connection terminal 121.

Furthermore, a first temperature rise test is arranged and then completed. There are a sample A and a sample B provided in the first temperature rise test. The sample A is constituted by the forgoing main body 11 and the first electrical conductive member 12. Particularly, in the sample A, the first connection terminal 121 of the first electrical conductive member 12 is fixed on the first welding platform 111P trough a rivet (i.e., one kind of fastener). On the contrary, in the sample B, the first connection terminal 121 of the first electrical conductive member 12 is welded on the first welding platform 111P trough an ultrasonic welding process. Related experimental data of the first temperature rise test are integrated in following Table (1).

TABLE 1

| Test current | Sample A Increment of temperature (° C.) | Sample B Increment of temperature (° C.) |
|---|---|---|
| 45A | 30.567 | 29.678 |
| 65A | 49.574 | 42.825 |
| 70A | 55.625 | 53.643 |

Second Embodiment

Figure 3:
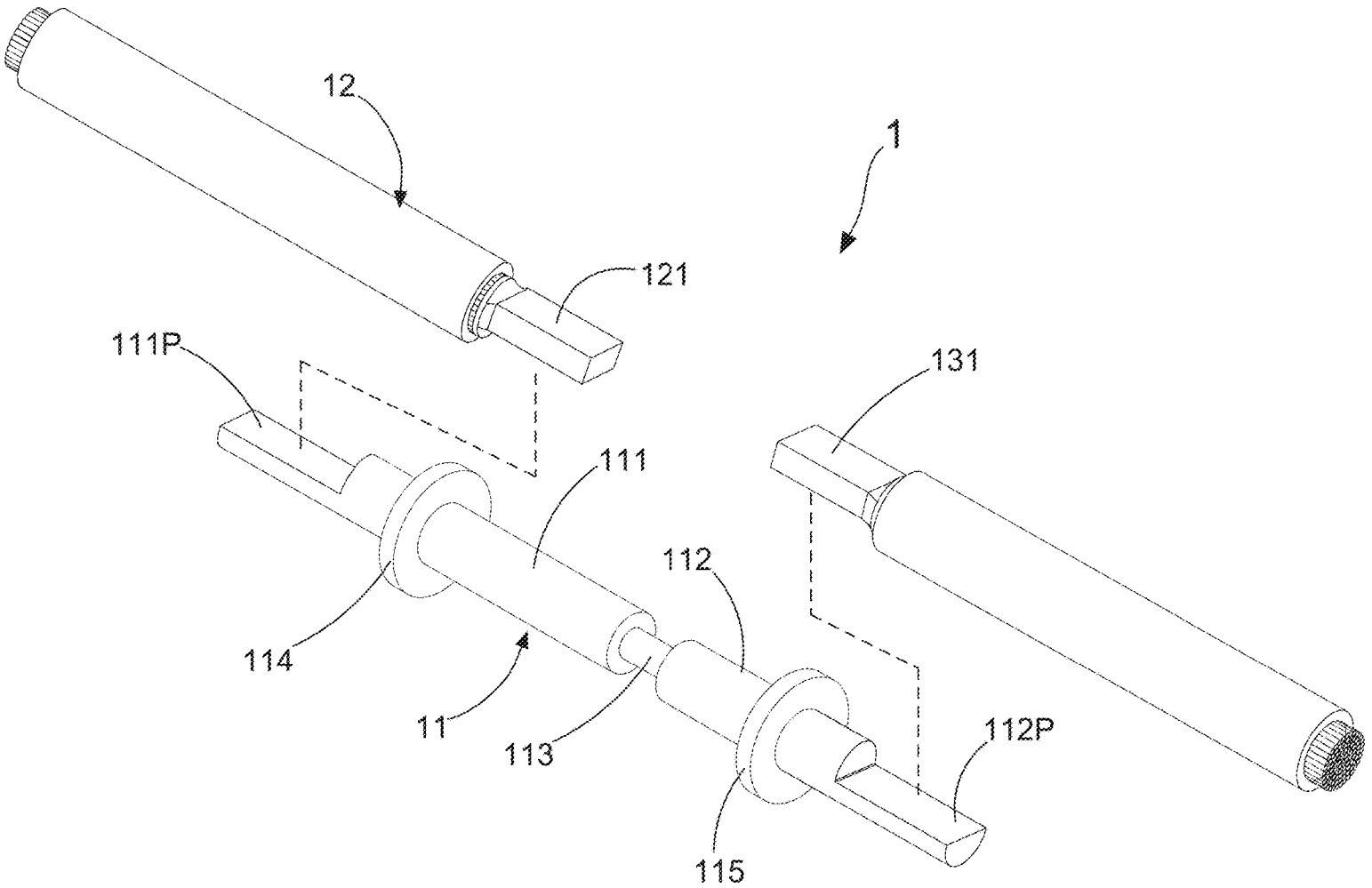
FIG. 3 shows a second exploded view of the terminal assembly according to the present invention.
Figure 4:
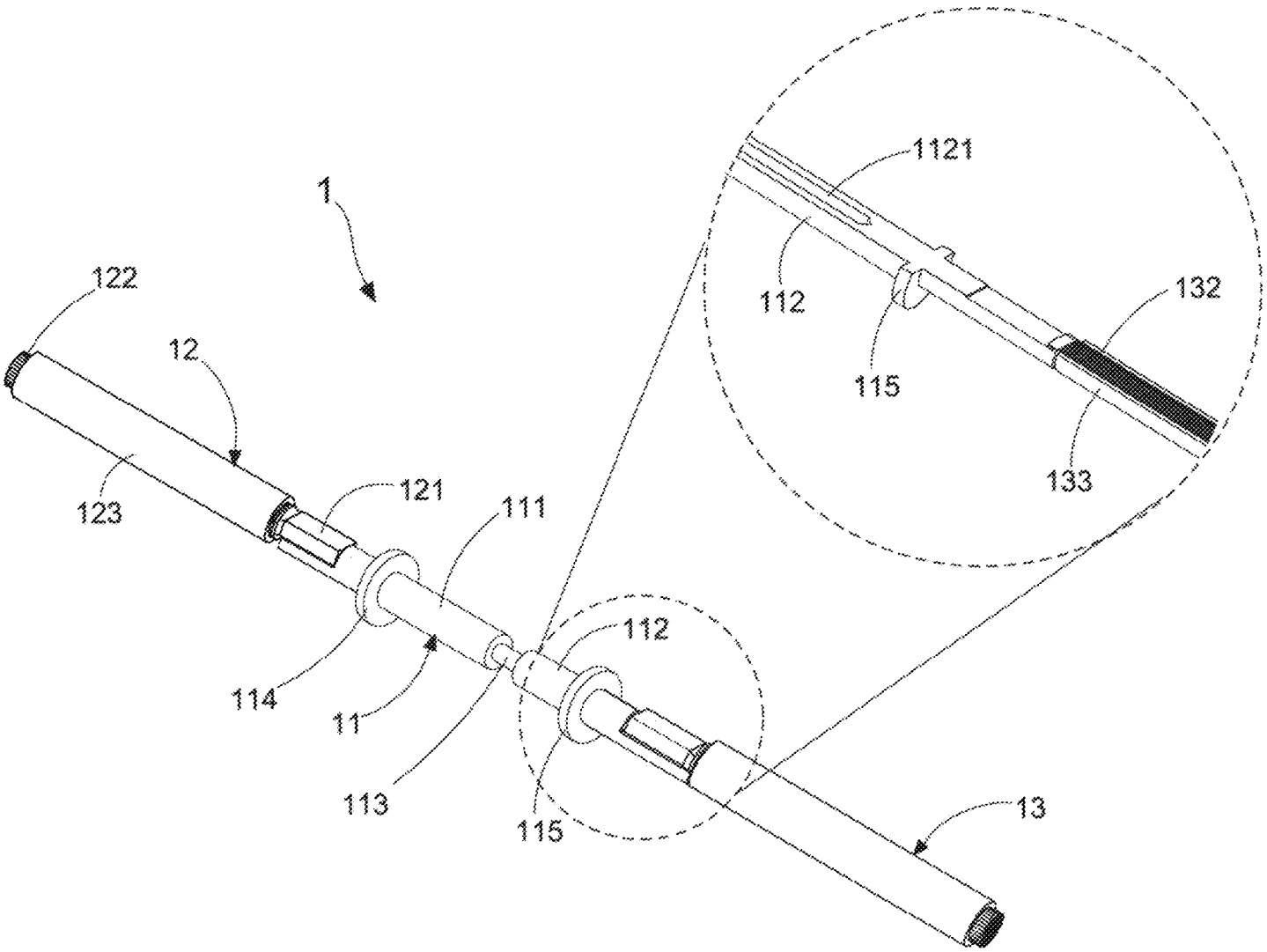
FIG. 4 shows a second stereo diagram of a terminal assembly according to the present invention.

With reference to FIG. 3, there is shown a second exploded view of the terminal assembly according to the present invention. Moreover, FIG. 4 shows a second stereo diagram of the terminal assembly. After comparing FIG. 3 with FIG. 2, it is understood that, in second embodiment, the terminal assembly 2 further comprises a second electrical conductive member 13, and the main body 11 further comprises a second connection part 112 and a middle connection part 113. As described in more detail below, the second electrical conductive member 13 has a second connection terminal 131. Moreover, one end of the second connection part 112 is an electrical conductive end, and another one end of the second connection part 112 is provided with a second welding platform 112P. In practicable embodiments, the second welding platform 112P can be a half-cylinder platform, a regular-hexahedron platform, or a rectangular-parallelepiped platform. For example, FIG. 3 and FIG. 4 depict that the second welding platform 112P is a rectangular-parallelepiped platform. Therefore, by operating an ultrasonic welding apparatus, the second connection terminal 131 of the second electrical conductive member 13 is welded on the second welding platform 112P of the second connection part 112, thereby forming a second welded structure is formed between the second connection part 112 and the second electrical conductive member 13.

As described in more detail below, there is a second circular-shaped flange 115 provided on the second connection part 112. Moreover, the second connection terminal 131 of the second electrical conductive member 13 is a stereo terminal, such as half-cylinder terminal, regular-hexahedron terminal, or rectangular-parallelepiped terminal. It is worth mentioning that, the second electrical conductive member 13 can be a conductive wire, and comprises a second electrical insulative sheath 133 and a plurality of second copper conductors 132 that are enclosed in the second electrical insulative sheath 133. As FIG. 3 and FIG. 4 show, the second copper conductors 132 are electrically connected to the second connection terminal 131. Furthermore, the middle connection part 113 is connected between the electrical conductive end of the second connection part 112 and the electrical conductive end of the first connection part 111.

For example, as and FIG. 4 shows, both the electrical conductive end of the second connection part 112 and the electrical conductive end of the first connection part 111 is provided with an embedding groove therein. By such arrangement, after making two ends of the middle connection part 113 be respectively embedded into the embedding groove of the first connection part 111 and the embedding groove of the second connection part 112, the middle connection part 113 is therefore connected between the electrical conductive end of the second connection part 112 and the electrical conductive end of the first connection part 111. Moreover, according to the present invention, the middle connection part 113 has a cross-section area that is smaller than a cross-section area of the first connection part 111, and the cross-section area of the middle connection part 113 is also smaller than that of the second connection part 112.

Third Embodiment

Figure 5:
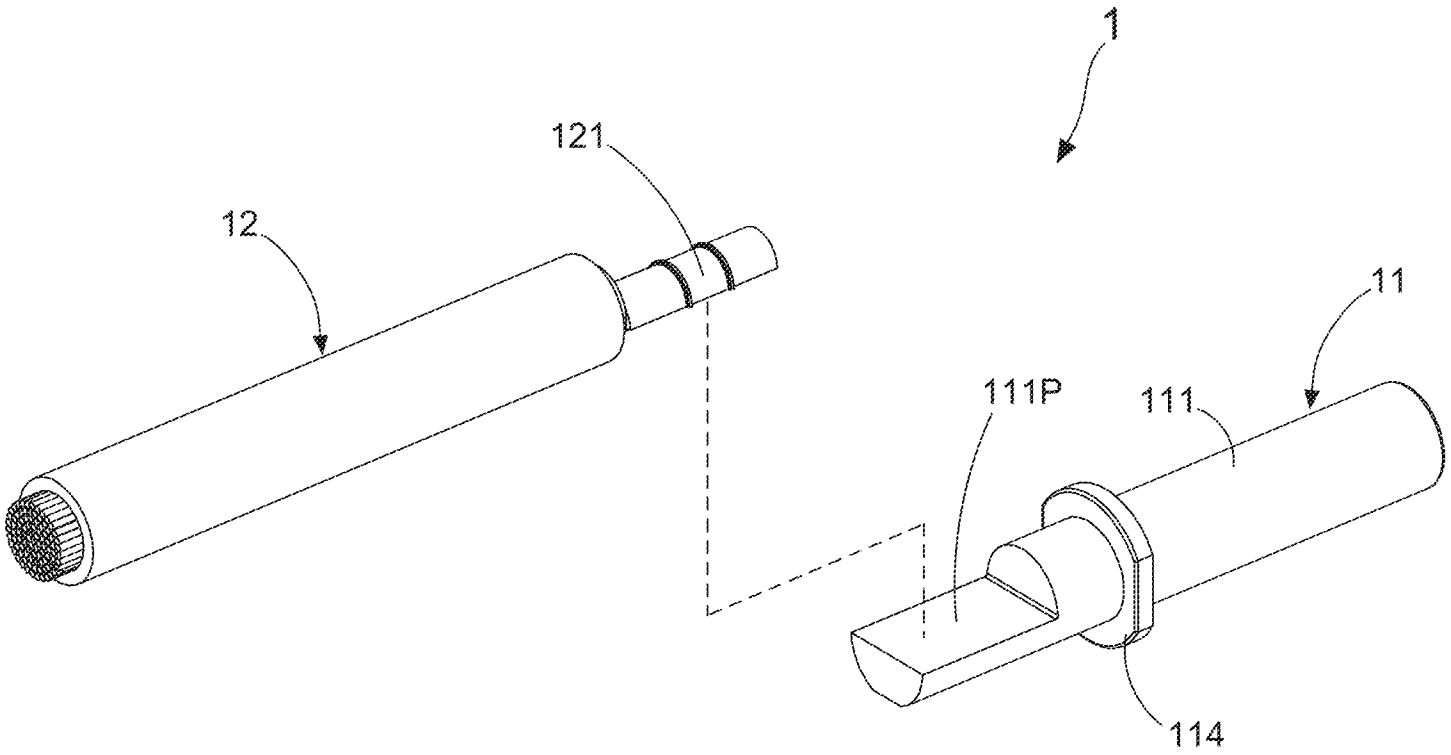
FIG. 5 shows a third exploded view of the terminal assembly according to the present invention.
Figure 6:
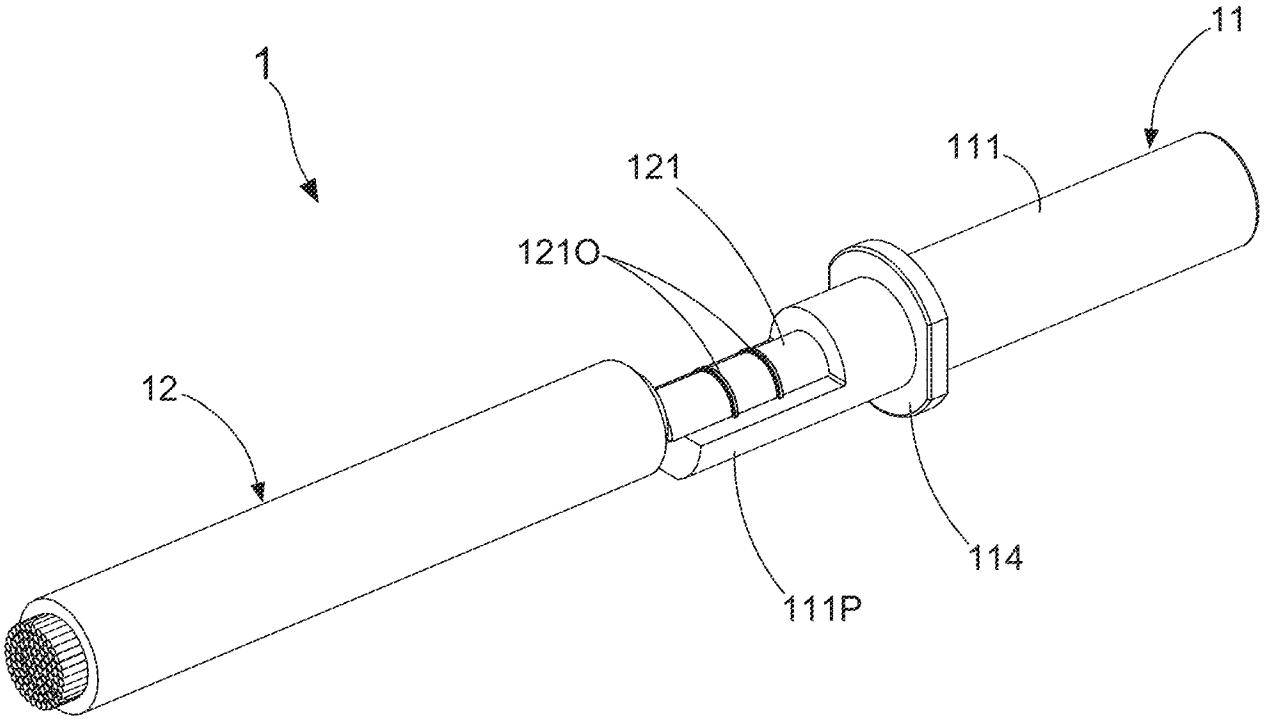
FIG. 6 shows a third stereo diagram of a terminal assembly according to the present invention.

With reference to FIG. 5, there is shown a second exploded view of the terminal assembly according to the present invention. Moreover, FIG. 6 shows a second stereo diagram of the terminal assembly. After comparing FIG. 5 with FIG. 3, it is understood that, in third embodiment, the first connection terminal 121 of the first electrical conductive member 12 is a half-cylinder terminal, and the first welding platform 111P is a half-cylinder platform. Moreover, there is a plurality of ribs 1210 formed on an outside surface of the first connection terminal 121 (i.e., the half-cylinder terminal).

Furthermore, a second temperature rise test is arranged and then completed. There are four samples of the second embodiment of the terminal assembly 1 provided in the second temperature rise test. Related experimental data of the second temperature rise test are integrated in following Table (2).

TABLE 2

| Type of welding platform | Test current (A) | Increment of temperature (° C.) Sample 1 | Sample 2 | Sample 3 | Sample 4 | Test result |
|---|---|---|---|---|---|---|
| rectangular-parallelepiped platform. | 65 | 51 | 54 | 75 | 53 | FAIL |
| half-cylinder platform | 45 | 27.147 | 25.645 | 30.567 | 29.678 | PASS |
| half-cylinder platform | 65 | 43.197 | 42.740 | 49.574 | 42.825 | PASS |
| half-cylinder platform | 70 | 51.65 | 50.176 | 55.625 | 53.643 | FAIL |

Therefore, through above descriptions, all embodiments and their constituting elements of the terminal assembly with welded structures according to the present invention have been introduced completely and clearly; in summary, the present invention includes the advantages of:

(1) The present invention discloses a terminal assembly 1, which mainly comprises a main body 11 having a first welding platform 111P and a first electrical conductive member 12 having a first connection terminal 121. According to the present invention, a welded structure is formed between the main body 11 and the first electrical conductive member 12 by making the first connection terminal 121 be welded on the first welding platform 111P. Briefly speaking, when utilizing this terminal assembly 1 to make two electrical nodes be electrically connected to each other, one electrical conductive end of the main body 11 and the first electrical conductive member 12 are firstly connected to the two electrical nodes, respectively. Next, a welding process is applied to the first welding platform 111P and the first connection terminal 121, such that an electrical connection is therefore established between the two electrical nodes. Therefore, the terminal assembly 1 according to the present invention includes advantages of simple structure and easy to be applied in achieving an electrical connection between two electrical nodes.

Therefore, through above descriptions, all embodiments and their constituting elements of the device for achieving dynamic charging and balance of battery cells according to the present invention have been introduced completely and clearly. The above description is made on embodiments of the present invention. However, the embodiments are not intended to limit scope of the present invention, and all equivalent implementations or alterations within the spirit of the present invention still fall within the scope of the present invention.

What is claimed is:

1. A terminal assembly, comprising:

a main body, comprising a first connection part, wherein one end of the first connection part is an electrical conductive end, and another one end of the first connection part is provided with a first welding platform; and a first electrical conductive member, comprising a first electrical insulative sheath, a plurality of first copper conductors enclosed in the first electrical insulative sheath, and a first connection terminal electrically connected to the first copper conductors:

wherein the first connection terminal has a semi-cylindrical block that comprises a flat top surface and a convex bottom surface, and the first welding platform also having a semi-cylindrical block that comprises a flat top surface and a convex bottom surface;

wherein a plurality of ribs are formed on the convex bottom surface of the semi-cylindrical block of the first connection terminal, and a first welded structure is formed between the first connection part and the first electrical conductive member by operating a ultrasonic welding machine to make the flat top surface of the first connection terminal be welded on the flat top surface of the first welding platform.

2. The terminal assembly of claim 1, wherein the main body further comprises a second connection part, wherein one end of the second connection part is also an electrical conductive end, and another one end of the second connection part being provided with a second welding platform laving a semi-cylindrical block.

3. The terminal assembly of claim 2, the main body further comprises a middle connection part that is connected between the electrical conductive end of the second connection part and the electrical conductive end of the first connection part.

4. The terminal assembly of claim 3, wherein the middle connection part has a cross-section area that is smaller than a cross-section area of the first connection part.

5. The terminal assembly of claim 3, wherein the middle connection part has a cross-section area that is smaller than a cross-section area of the second connection part.

6. The terminal assembly of claim 2, further comprising:

a second electrical conductive member, having a second connection terminal;

wherein the second connection terminal has a semi-cylindrical block that comprises a flat top surface and a convex bottom surface, and the second welding platform also having a semi-cylindrical block that comprises a flat top surface and a convex bottom surface;

wherein a second welded structure is formed between the second connection part and the second electrical conductive member by operating, said ultrasonic welding machine to make the flat top surface of the second connection terminal be welded on the flat top surface of the second welding platform.

7. The terminal assembly of claim 6, wherein the second electrical conductive member comprises:

a second electrical ins dative sheath; and a plurality of second copper conductors, being enclosed in the second electrical insulative sheath, and being electrically connected to the second connection terminal.

8. The terminal assembly of claim 2, wherein there is a first circular-shaped flange provided on the first connection part, and there being a second circular-shaped flange provided on the second connection part.

* * * * *